US010648339B2

(12) United States Patent
Mahle et al.

(10) Patent No.: US 10,648,339 B2
(45) Date of Patent: May 12, 2020

(54) CONTOURING A BLADE/VANE CASCADE STAGE

(71) Applicant: MTU Aero Engines AG, Munich (DE)

(72) Inventors: Inga Mahle, Munich (DE); Markus Brettschneider, Karlsfeld (DE); Fadi Maatouk, Munich (DE)

(73) Assignee: MTU Aero Engines AG, Munich (DE)

( * ) Notice: Subject to any disclaimer, the term of this patent is extended or adjusted under 35 U.S.C. 154(b) by 145 days.

(21) Appl. No.: 15/908,401

(22) Filed: Feb. 28, 2018

(65) Prior Publication Data

US 2018/0252107 A1 Sep. 6, 2018

(30) Foreign Application Priority Data

Mar. 3, 2017 (EP) ..... 17159076

(51) Int. Cl.
*F01D 5/14* (2006.01)
*F01D 9/04* (2006.01)

(52) U.S. Cl.
CPC ..... *F01D 5/145* (2013.01); *F01D 5/143* (2013.01); *F01D 9/041* (2013.01); *F05D 2220/30* (2013.01); *F05D 2240/129* (2013.01); *F05D 2240/80* (2013.01)

(58) Field of Classification Search
None
See application file for complete search history.

(56) References Cited

U.S. PATENT DOCUMENTS 6,602,050 B1 * 8/2003 Scheurlen ..... F01D 11/08 415/173.1
8,834,129 B2 9/2014 Barnes et al.
2008/0232968 A1 9/2008 Nguyen
2010/0284818 A1 * 11/2010 Sakamoto ..... F01D 5/143 416/241 R
2012/0124963 A1 * 5/2012 Howe ..... A63F 13/12 60/204
2013/0108433 A1 * 5/2013 Green ..... F01D 5/143 415/208.2
2013/0136621 A1 * 5/2013 Wunderer ..... F01D 5/145 416/243
2013/0156562 A1 * 6/2013 Mahle ..... 415/191
2014/0037453 A1 * 2/2014 Engel ..... F01D 5/12 416/204 R (Continued)

FOREIGN PATENT DOCUMENTS

CA 2333843 8/2001
DE 102010007985 A1 9/2010

(Continued)

*Primary Examiner* — Michael Lebentritt
(74) *Attorney, Agent, or Firm* — Barlow, Josephs & Holmes, Ltd.

(57) ABSTRACT

A blade/vane cascade segment for a blade/vane cascade of a turbomachine includes a stage and at least two blade/vane elements that define a blade/vane intermediate strip with an axial cascade span on the stage surface by their leading and trailing edges. A stage edge on the inflow side has a contour with a depression. In the axial direction, this depression extends at most by 10% of the cascade span into the blade/vane intermediate strip. Also provided is a corresponding stage, a blade/vane cascade, a blade/vane channel, and a turbomachine.

14 Claims, 1 Drawing Sheet

(56) References Cited

U.S. PATENT DOCUMENTS

Figure 1:
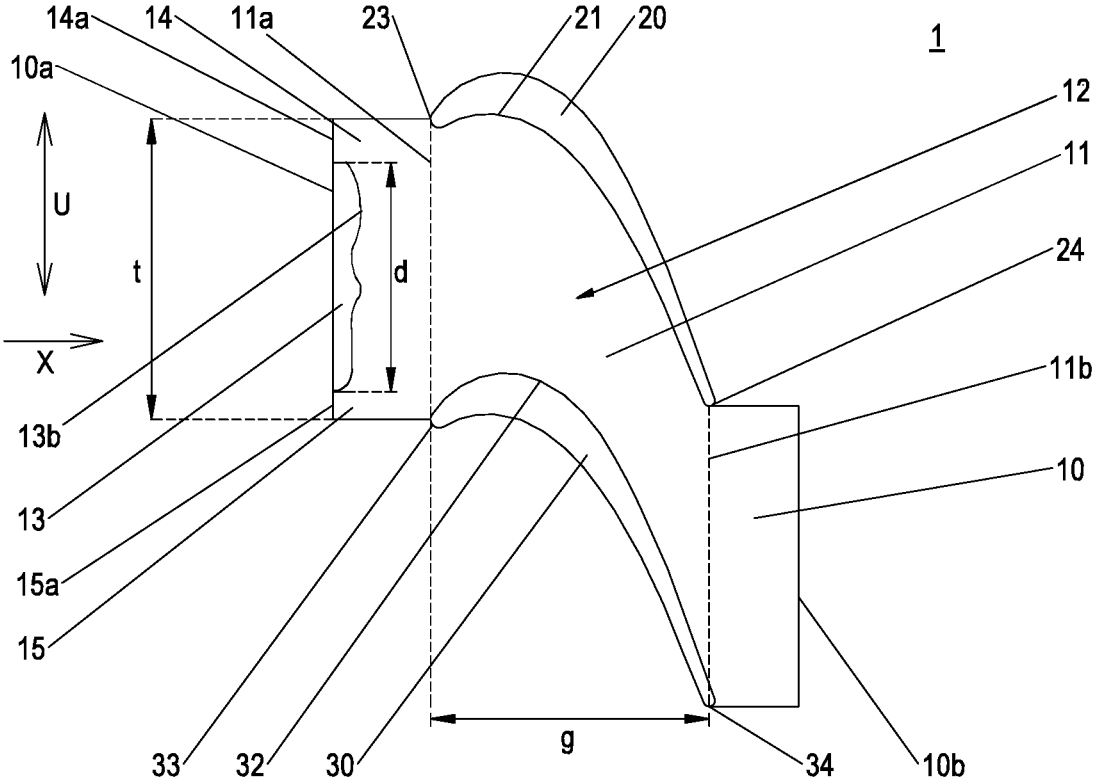

| | | | | |
|---|---|---|---|---|
| 2014/0150403 | A1* | 6/2014 | Stuart | F02K 1/72 60/204 |
| 2015/0107265 | A1* | 4/2015 | Smith | F01D 5/143 60/805 |
| 2016/0263820 | A1* | 9/2016 | Kruckenberg | B29C 66/301 |
| 2017/0159606 | A1* | 6/2017 | Stuart | F02K 1/70 |
| 2018/0223670 | A1* | 8/2018 | Brettschneider | F01D 5/143 |
| 2018/0298761 | A1* | 10/2018 | Brettschneider | F01D 9/041 |

FOREIGN PATENT DOCUMENTS

| | | | | |
|---|---|---|---|---|
| EP | 1126132 | A2 | 8/2001 | |
| EP | 1995410 | A1 * | 11/2008 | F01D 5/143 |
| EP | 2261462 | A1 * | 12/2010 | F01D 5/143 |
| EP | 2372088 | A2 | 10/2011 | |
| EP | 2372102 | A2 | 10/2011 | |
| EP | 2458148 | A1 * | 5/2012 | F01D 5/143 |
| EP | 2487329 | A1 * | 8/2012 | F01D 5/143 |
| EP | 2487329 | B1 | 11/2013 | |
| EP | 2787172 | A2 | 10/2014 | |
| EP | 2696029 | B1 | 10/2015 | |
| WO | 9844240 | A1 | 10/1998 | |
| WO | 2015092204 | A1 | 6/2015 | |

* cited by examiner

CONTOURING A BLADE/VANE CASCADE STAGE

BACKGROUND OF THE INVENTION

The present invention relates to a blade/vane cascade segment, a blade/vane cascade, a stage, and a blade/vane channel of a turbomachine, as well as a turbomachine.

Turbomachines (such as gas and steam turbines) generally have a flow channel for conducting a fluid. The flow channel, which is also called an "annular space" is bounded radially inward by the shaft of a rotor and radially outward by a casing; the designations "radially" as well as "axially" and "peripheral direction", and terms derived therefrom are always to be understood with reference to a (provided) axis of rotation of the rotor in this document—as long as nothing is indicated to the contrary.

Blade/vane cascades (for which the denotation "blade/vane ring" is also common) are arranged in the annular space of a turbomachine. They each comprise guide vanes or rotating blades that lie one behind the other in the peripheral direction at essentially regular distances, as well as stages belonging thereto, which are also called "cover plates", and that have a stage edge on the inflow side and on the outflow side. These stage edges bound the stage surface facing the blades/vanes (or blade/vane elements) in the axial direction.

In this document, the stage edge "on the inflow side" is designated as the stage edge where the leading (axial) principal flow first passes through the annular space of the turbomachine during operation; correspondingly, the stage edge "on the outflow side" is the other edge. The principal flow thus passes through the stage bounded upstream/downstream by the stage edges on the inflow side/outflow side, i.e., the stage is directly adjacent to the flow. This stage, in particular, is thus not a "wing" displaced radially downward, which, during operation, is overlapped by an adjacent stage on the inflow side or the like, and is distanced from the principal flow that does not pass through it. The stage bounded by the stage edge on the inflow side and outflow side also does not comprise such a wing. The principal flow thus flows into the stage edge on the inflow side during operation. The indications "downstream" or "upstream", respectively, refer correspondingly to the axial principal flow direction, and thus only to the axial position, regardless of a possible displacement in the peripheral direction: In particular, in this document, a point is to be understood as lying "downstream of the inflow edges" if it is arranged displaced axially in the direction of principal flow relative to a direct connection line between the inflow edges at the stage surface.

The pressure side of a blade/vane and the suction side of an adjacent blade/vane each bound a so-called blade/vane channel in the peripheral direction. In the radial direction, this blade/vane channel is bounded by so-called side walls within the turbomachine. These side walls are formed, on one hand, by the stages, and, on the other hand, by sections lying radially opposite to these stages: In the case of rotating blades, such a side wall is a radially outer-lying section (in particular, a section of the casing); in the case of guide vanes, it is a radially inner-lying section (in particular, a rotor hub).

The section of the stage surface that is bound in the axial direction by directly connecting the inflow (leading) edges or the outflow (trailing) edges, respectively, of adjacent blade/vane elements at the stage surface (or by a projection of a straight connection between the named edges in the radial direction onto the stage surface), and is bound in the peripheral direction by the suction side or pressure side thereof, is called in this document a "blade/vane intermediate strip". The width of the blade/vane intermediate strip in the peripheral direction is named the "pitch distance" between the blade/vane cascade. It can be measured, in particular, as the distance between the leading edges of adjacent blades/vanes in the peripheral direction at the stage surface. The depth of the blade/vane intermediate space in the axial direction, thus the distance between the leading edges of the blade/vane elements and the trailing edges thereof that is measured parallel to the provided axis of rotation of the turbomachine is referred to as the "cascade span".

A fluid flow conveyed through a flow channel is periodically influenced by the surfaces of the side walls. Flow layers that run next to these surfaces are more strongly diverted here, due to their slower speed, than flow layers that are further away from the side walls. Thus, a secondary flow that is superimposed on an axial principal flow arises and, in particular, leads to vortexes and pressure losses.

In order to reduce secondary flows, contouring is frequently introduced in the side walls in the form of elevations and/or depressions.

A plurality of these types of so-called "side wall contouring" are known from the prior art. By way of example, the patents or patent applications of the Applicant will be named: EP 2 487 329 B1; EP 2 787 172 A2; and EP 2 696 029 B1.

Furthermore, a flow channel having a side wall is known from the publication EP 1 126 132 A2, this channel having a radial depression in the region of the leading edges of the blade/vane elements. This depression extends in the axial direction over the majority of the flow channel and ends only just in front of, or perhaps behind the trailing edges. The surface of the flow-through region between leading and trailing edges will be locally enlarged thereby, which shall improve the efficiency of the rotor.

EP 2 372 088 A2 discloses an integrally fabricated turbine bladed disk, which has a ring with edges on the inflow and outflow sides, and rotating blades as well as depressions—in the region of the leading edges of the rotating blade elements—are arranged in the ring surface between these edges.

SUMMARY OF THE INVENTION

The object of the present invention is to provide an alternative technique for a turbomachine, with which secondary flows can be reduced in an advantageous way.

The object is achieved by a blade/vane cascade segment, a blade/vane cascade, a blade/vane channel, a stage, and a turbomachine according to the present invention. Advantageous embodiments are disclosed herein and in the figures.

A blade/vane cascade segment according to the invention for a blade/vane cascade of a turbomachine comprises a stage and at least two (adjacent) blade/vane elements, which define a blade/vane intermediate strip with axial cascade span corresponding to the above-named concept, by their inflow and outflow edges on the stage surface. The stage has a stage edge on the inflow side and this edge has a contour with a depression. In the axial direction, this depression extends at most by 10% of the cascade span into the blade/vane intermediate strip. In particular, the depression can be arranged completely upstream of the inflow edges, thus cannot project into the blade/vane intermediate strip.

Referred to the stage edge on the inflow side, the depression is thus to be understood as a local shaping of a line that results along the edge of the stage from the cross section of a (planar) depression lying in the two-dimensional stage surface. In this document, a local shaping in the stage surface, in which the latter extends to the side facing away from the blade/vane elements is to be understood as such a "depression". The designation (just like terms such as "lowered" or depressed or the like) is thus based here on an orientation or a coordinate system, respectively, in which the blade/vane elements extend toward the "top" from the stage surface, and a depression correspondingly leads in the opposite direction (toward the "bottom").

The depression is thus completely arranged inside a surface strip of the stage surface, whose boundary on the outflow side runs in the axial direction by at most 10% of the cascade span downstream of the inflow edges; in particular, the depression is lowered in all its points with respect to this boundary (whereby one edge of the depression can be viewed as not belonging to it). The depression is preferably formed coherently in the contour of the stage edge on the inflow side. According to a special embodiment, the boundary on the outflow side in fact is not wider than (at most) 5% of the cascade span downstream of the leading edges of the blade/vane elements.

A blade/vane cascade segment according to the invention can be of one piece or it can be a composite. In particular, the stage can be of one piece or comprise two or more parts, from which a blade/vane element projects in each case, or the stage can be formed as at least a separate component that is arranged or can be arranged between the blade/vane elements. Correspondingly, a stage according to the invention is set up for the purpose of bounding a blade/vane element on each side in the peripheral direction, and, along with the blade/vane elements (none, one, or both of which can be rigidly shaped on the stage) to form together a blade/vane cascade segment according to the invention according to one of the embodiments disclosed in this document.

A blade/vane cascade according to the invention comprises at least one blade/vane cascade segment according to the invention according to one of the embodiments disclosed in this document. A turbomachine according to the invention comprises one or a plurality of blade/vane cascade(s) according to the invention.

A blade/vane channel according to the invention leads through a blade/vane cascade segment according to the invention according to one of the embodiments disclosed in this document; thus it is bounded by such a blade/vane cascade segment as well as a side wall lying opposite a stage thereof (facing the stage surface). In particular, the blade/vane channel is bounded in the peripheral direction by the pressure side of one of the blade/vane elements of the blade/vane cascade segment and by the suction side of the other (adjacent) blade/vane element lying opposite thereto.

A blade/vane cascade segment according to the invention, a blade/vane cascade according to the invention, a blade/vane channel according to the invention, a stage according to the invention, and a turbomachine according to the invention each make possible an improvement of the secondary flows, and therefore, a reduction of losses in the respective hub or casing region. A high efficiency of the turbomachine can thus be achieved.

The blade/vane cascade segment or the blade/vane cascade or the flow channel or the stage, respectively, can be, in particular, part of a low-pressure turbine. The blade/vane cascade can be a guide vane cascade or a rotating blade cascade; the blade/vane elements can thus be guide vane or rotating blade elements in each case. The stage can be set up for the purpose of bounding a blade/vane channel by the blade/vane cascade segment radially inward or radially outward.

The stage edge on the inflow side is preferably equipped for the purpose of being used in the turbomachine (at least essentially) adjacent to another (separate) element (e.g., of the hub or of the casing or of another blade/vane cascade). It can be equipped for the purpose of forming a section of a wall of a gap through which cooling fluid will be introduced or will be able to be introduced into the annular space of the turbomachine. In the peripheral direction, the stage edge on the inflow side (which can comprise sections of several parts of a multipart stage) is preferably bounded by the (peripheral direction) positions of the leading edges of the two blade/vane elements; these boundaries can have a physical shaping (e.g., in that the stage terminates in them in the peripheral direction) or can be established or are to be established only abstractly for the definition of the stage edge on the inflow side. In the peripheral direction, in particular, the stage edge on the inflow side preferably has an extent (or length) that is (essentially) equal to the pitch distance.

One embodiment of the present invention has been demonstrated as particularly advantageous, in which the depression extends along the stage edge on the inflow side (preferably continuously) over at least 50% of the pitch distance.

Preferably, the depression has a positive distance (>0) from the pressure side of one of the blade/vane elements and/or from the suction side of the other blade/vane element, so that it thus does not contact the respective side. The depression can be distanced equally or differently from the two blade/vane elements. In particular, the distance of the depression relative to the leading edge of one blade/vane (e.g., which bounds the region of the blade/vane intermediate space on its pressure side) can be larger or smaller than the distance between the depression and the leading edge of the other blade/vane. Such an axial asymmetry can be used for a different influencing of the flow by the suction and pressure sides of the blades/vanes in the sense of a reduction of secondary flows.

In particular, an embodiment of the present invention has been demonstrated as advantageous, in which the stage edge (or its contour) on the inflow side is formed asymmetrically relative to its radial central axis, i.e., a radial axis that runs through the center of the stage edge on the inflow side.

In the case of a preferred variant of embodiment of the present invention, the stage surface comprises a surface area region that is arranged between the depression and a pressure side of one (the first) of the blade/vane elements. Preferably, such a surface area region is detected by the stage edge on the inflow side. The contour of the stage edge on the inflow side thus comprises an edge of the surface area region, which is called the surface area region "on the pressure side" in the following. In particular, a section of the stage edge on the inflow side, in which the latter detects the surface area region on the pressure side, can extend in the peripheral direction, preferably over at least 10% or at least 20% of the pitch distance. In this case, every point of the depression is preferably lowered in comparison to every point of the surface area region on the pressure side (in the radial direction).

Analogously, the stage surface may comprise a surface area region that is disposed between the depression and a suction side of the other (the second) of the blade/vane elements. Preferably, such a surface area region is detected by the stage edge on the inflow side. The contour of the stage edge on the inflow side thus comprises an edge of the surface area region, which is called the surface area region "on the suction side" in the following. In particular, a section of the stage edge on the inflow side, in which the latter detects the surface area region on the suction side, can extend in the peripheral direction, preferably over at least 10% or at least 20% of the pitch distance. In this case, every point of the depression is preferably lowered in comparison to every point of the surface area region on the suction side (in the radial direction).

A combination of these embodiments in which the stage surface thus comprises a surface area section on both the pressure side and the suction side (optionally, with the additional named properties) has been demonstrated to be particularly advantageous. According to one embodiment, an edge section in which the stage edge on the inflow side detects the surface area region on the suction side is larger than an edge section of the stage edge on the inflow side in which the latter detects the surface area region on the pressure side; in another variant, the opposite applies, and in another embodiment, both sections are of the same size.

Outside of the depression, the stage surface can be formed without contouring.

BRIEF DESCRIPTION OF THE DRAWING FIGURES

Preferred embodiment examples of the invention will be explained in more detail in the following based on drawings. It is understood that individual elements and components can also be combined in ways other than what is shown. Reference numbers for elements corresponding to one another are used in an overlapping way in the figures and are not newly described for each figure.

Figure 2:
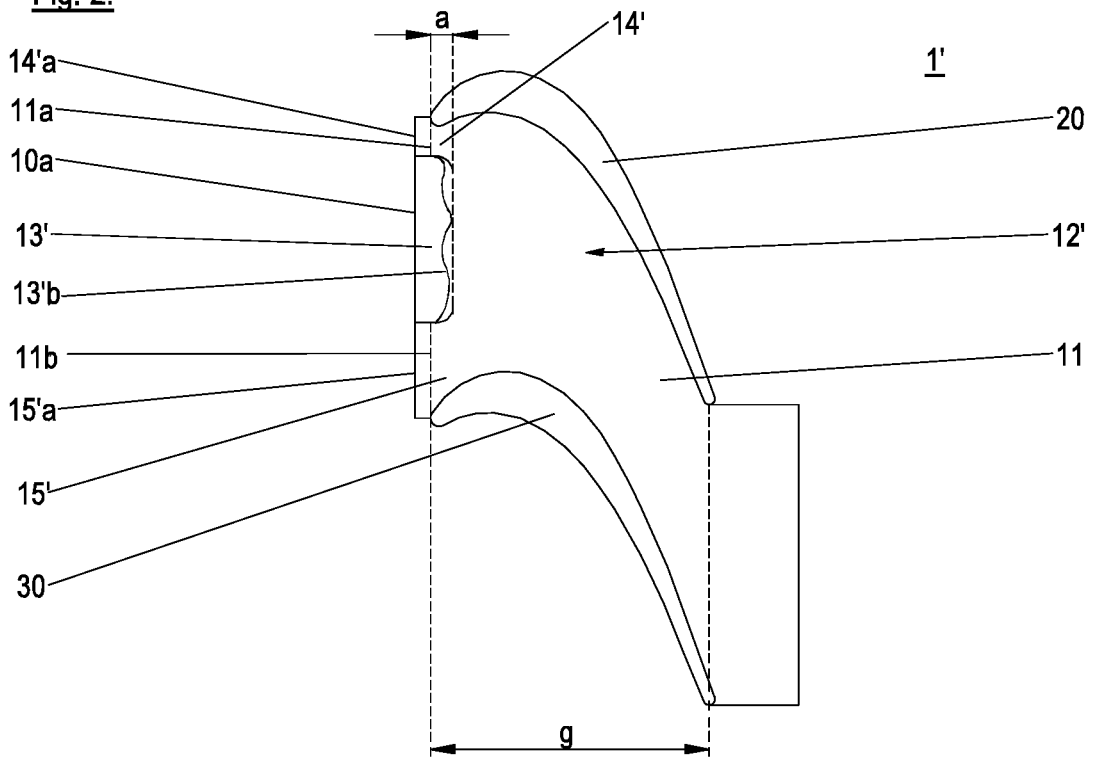

Herein, shown schematically:

FIG. 1 shows an uncoiled blade/vane cascade segment of an exemplary embodiment of the present invention in top view; and FIG. 2 shows an uncoiled blade/vane cascade segment of an alternative exemplary embodiment of the present invention in top view.

DESCRIPTION OF THE INVENTION

An exemplary (uncoiled) embodiment of a blade/vane cascade segment 1 according to the invention is shown schematically in FIG. 1 in top view; the viewing direction in this case corresponds to the radial direction (toward the outside or toward the inside, each time depending on whether the stage 10 is part of an outer or an inner side wall). The blade/vane cascade segment comprises adjacent blade/vane elements 20, 30 and a stage 10 according to the invention, which has a stage surface 12, a stage edge 10*a* on the inflow side (referred to the provided axial direction of principal flow X, and a stage edge 10*b* on the outflow side. The stage edge 10*a* on the inflow side can comprise sections of several parts of a multipart stage (although these are not shown). It is bounded by the (peripheral direction) positions of the leading edges 23, 33, of the two blade/vane elements 20, 30; in particular, the extent (or length) of the stage edge 10*a* on the inflow side is thus equal to the pitch distance t in the peripheral direction.

In another embodiment (not shown), a wing displaced radially downward, i.e., relative to the axis of rotation, can still be found on the inflow side of the stage edge 10*a* on the inflow side, this wing being distanced from the principal flow during operation and forming no part of the stage 10 according to the present disclosure.

The pressure side 21 of one blade/vane element 20 and the suction side 32 of the other blade/vane element 30 bound a blade/vane intermediate strip 11 in the peripheral direction U of the blade/vane cascade belonging thereto; in the axial direction this blade/vane intermediate strip is bounded by a straight connection 11*a* running along the stage in the top view (thus a corresponding projection) of the leading edges 23, 33 on one side, and by a corresponding connection 11*b* of the trailing edges 24, 34 of the blade/vane elements 20, 30. There results an (axial) cascade span g.

The stage surface has a depression 13, which is detected by the stage edge 10*a* on the inflow side. In the cross section (along a plane that is perpendicular to the provided axis of rotation), it results that the stage edge 10*a* on the inflow side has a contour having a depression 13 (in the form of a sink) (not shown directly in the figure, but is implied by it).

The depression is disposed completely upstream of the blade/vane intermediate strip 11 in the example shown. It extends along the stage edge 10*a* on the inflow side coherently (thus continuously) over an extent d, which is greater than 50% of the pitch t. In this way, a boundary 13*b* of the depression 13 on the outflow side has an axial distance, which changes with its course, relative to the stage edge 10*a* on the inflow side; according to another exemplary embodiment (not shown), a boundary on the outflow side of the depression 13 could essentially extend in the peripheral direction U without axial deviations, and thus could run parallel to the stage edge 10*a* on the inflow side in a radial projection onto the stage surface (not shown).

The stage surface has a pressure-side surface area section 14 disposed between the pressure side 21 of the blade/vane element 20 and the depression 13 and reaching to the leading stage edge 10*a*, as well as a suction-side surface area section 15 disposed between the suction side 32 of the blade/vane element 30 and the depression 13 and reaching to the leading edge of the stage. The depression 13 in this case is depressed completely in the radial direction in comparison to each point of the section 14 on the pressure side and to each point of the section 15 on the suction side (which is not visible in the figure, again due to the illustration in top view).

The surface area section 14 on the pressure side and reaching to the leading stage edge 10*a* extends in a continuous edge section 14*a* along the leading stage edge 10*a*. Analogously, the section 15 on the suction side and reaching to the leading stage edge extends in a continuous edge section 15*a* along the leading stage edge 10*a*. In the exemplary embodiment shown in FIG. 1, the edge section 15*a* is smaller than the edge section 14*a*. In particular, the stage edge 10*a* on the inflow side is asymmetric relative to its radial central axis (not shown in the figure), thus relative to a radial axis that runs through the center of the stage edge 10*a* on the inflow side.

FIG. 2 shows schematically an uncoiled alternative embodiment of a blade/vane cascade segment 1' according to the invention in top view. Like the blade/vane cascade segment 1 shown in FIG. 1, it has blade/vane elements 20, 30 and a stage 10 according to the invention with a stage edge 10*a* on the inflow side and a stage edge 10*b* on the outflow side (relative to the provided axial principal flow direction X).

The stage surface of the stage 10 of the blade/vane cascade segment 1' comprises a depression 13' running along the inflow-side stage edge 10*a*, this depression being detected by the stage edge 10*a* on the inflow side. In the cross section (along a plane that is perpendicular to the provided axis of rotation) a contour also results here comprising the depression 13' in the form of a coherent sink in the stage edge 10*a* on the inflow side (again, not shown directly in the figure, but implied by it).

A boundary 13'*b* of the depression 13' on the outflow side also has a distance changing with its course in the axial direction relative to the stage edge 10*a* on the inflow side in the example shown in FIG. 2; according to other examples of embodiment (not shown), a boundary of the depression on the outflow side extends essentially without axial deviations in the peripheral direction (thus runs parallel to the stage edge 10*a* on the inflow side in the projection onto the stage surface). The depression 13' in this case is arranged on the inside of a surface strip of the stage surface 12'; the boundary thereof on the outflow side runs in the peripheral direction and lies by the axial distance a downstream of the leading edges 23, 33, of the blade/vanes 20, 30. Here, according to the invention, a ≤0.1 g, where g is the axial cascade span. The depression 13' thus projects by at most 10% of the axial cascade span g into the blade/vane intermediate strip 11.

The stage surface has a pressure-side surface area section 14' disposed between the pressure side 21 of the blade/vane element 20 and the depression 13' and reaching to the leading stage edge 10*a*, as well as a suction-side surface area section 15' disposed between the suction side 32 of the blade/vane element 30 and the depression 13' and reaching to the leading stage edge. The depression 13' in this case is depressed completely in the radial direction in comparison to each point of the section 14' on the pressure side and to each point of the section 15' on the suction side (which again is not visible in the figure due to the illustration in top view).

The surface area section 14' on the pressure side and reaching to the leading stage edge extends continuously in an edge section 14'*a* along the leading stage edge 10*a*. Analogously, the section 15' on the suction side and reaching to the leading stage edge extends continuously in an edge section 15'*a* along the leading stage edge 10*a*. In the exemplary embodiment shown in FIG. 2, the edge section 15'*a* is larger than the edge section 14'*a*; in a special exemplary embodiment, the edge section 15'*a* can be at least 1.5 times or in fact at least double the size of the edge section 14'*a*.

Disclosed is a blade/vane cascade segment 1, 1' for a blade/vane cascade of a turbomachine, which comprises a stage 10 and at least two blade/vane elements 20, 30, which define a blade/vane intermediate strip 11 with axial cascade span g on the stage surface by their leading and trailing edges 23, 33, 24, 34. A stage edge 10*a* on the inflow side has a contour with a depression 13, 13'. In the axial direction, this depression 13, 13' extends at most by 10% of the cascade span g into the blade/vane intermediate strip 11.

Also disclosed are a corresponding stage, a blade/vane cascade, a blade/vane channel, and a turbomachine.

It would be appreciated by those skilled in the art that various changes and modifications can be made to the illustrated embodiments without departing from the spirit of the present invention. All such modifications and changes are intended to be covered by the appended claims.

What is claimed is:

1. A blade/vane cascade segment for a blade/vane cascade of a turbomachine, comprising:

a stage with a stage surface and a stage edge on the inflow side as well as at least two blade/vane elements that define a blade/vane intermediate strip with an axial cascade span on the stage surface by their leading and trailing edges;

the stage edge on the inflow side has a contour with a depression that extends in an axial direction at most by 10% of the cascade span into the blade/vane intermediate strip.

2. The blade/vane cascade segment according to claim 1, wherein the depression along the stage edge on the inflow side comprises at least 50% of the pitch distance.

3. The blade/vane cascade segment according to claim 1, wherein the stage edge on the inflow side is formed asymmetric to its radial central axis.

4. The blade/vane cascade segment according to claim 1, wherein the stage surface comprises a surface area region on the pressure side, which is disposed between a pressure side of one of the blade/vane elements and the depression.

5. The blade/vane cascade segment according to claim 1, wherein an edge section, in which the stage edge on the inflow side detects the surface area region on the pressure side, comprises at least 10% of the pitch distance.

6. The blade/vane cascade segment according to claim 1, wherein the stage surface comprises a surface area region on the suction side, which is disposed between a suction side of one of the blade/vane elements and the depression.

7. The blade/vane cascade segment according to claim 1, wherein an edge section, in which the stage edge on the inflow side detects the surface area region on the suction side, comprises at least 10% of the pitch distance.

8. The blade/vane cascade segment according to claim 1, wherein the depression is disposed completely upstream of the leading edges.

9. The blade/vane cascade segment according to claim 1, wherein the blade/vane cascade is a guide vane cascade or a rotating blade cascade.

10. The blade/vane cascade segment according to claim 1, wherein a boundary of the depression on the outflow side runs substantially parallel to the stage edge on the inflow side.

11. The blade/vane cascade segment according to claim 1, wherein two or more blade/vane cascade segments are provided in a blade/vane cascade.

12. The blade/vane cascade segment according to claim 1, wherein a blade/vane channel of a turbomachine is bounded by a blade/vane cascade segment and by a side wall lying opposite to the stage of the blade/vane cascade segment.

13. The blade/vane cascade segment according to claim 1, wherein a stage is configured and arranged to bound the at least two blade/vane elements in the peripheral direction.

14. The blade/vane cascade segment according to claim 1, wherein at least one blade/vane cascade is configured and arranged in a turbomachine.

* * * * *